US006558892B2

(12) United States Patent
Elst et al.

(10) Patent No.: US 6,558,892 B2
(45) Date of Patent: May 6, 2003

(54) METHOD OF PREPARING ULTRATHIN LIGHT-SENSITIVE TABULAR GRAIN EMULSIONS RICH IN SILVER BROMIDE

(75) Inventors: Kathy Elst, Kessel (BE); Ilse Mans, Herenthout (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/902,950

(22) Filed: Jul. 11, 2001

(65) Prior Publication Data

US 2002/0037485 A1 Mar. 28, 2002

Related U.S. Application Data

(60) Provisional application No. 60/227,046, filed on Aug. 21, 2000.

(30) Foreign Application Priority Data

Aug. 1, 2000 (EP) ..... 00202740

(51) Int. Cl.[7] ..... G03C 1/005; G03C 1/08

(52) U.S. Cl. ..... 430/569; 430/567; 430/966; 430/967

(58) Field of Search ..... 430/567, 569, 430/966, 967

(56) References Cited

U.S. PATENT DOCUMENTS

| | | | | | |
|---|---|---|---|---|---|
| 4,914,014 | A | | 4/1990 | Daubendiek et al. | 430/569 |
| 4,942,120 | A | * | 7/1990 | King et al. | 430/567 |
| 5,206,134 | A | * | 4/1993 | Yamada et al. | 430/569 |
| 5,567,580 | A | * | 10/1996 | Fenton et al. | 430/567 |
| 5,582,965 | A | * | 12/1996 | Deaton et al. | 430/567 |
| 5,604,085 | A | * | 2/1997 | Maskasky | 430/567 |
| 5,614,358 | A | * | 3/1997 | Wilson et al. | 430/567 |
| 5,629,142 | A | * | 5/1997 | Maskasky | 430/502 |
| 5,641,618 | A | * | 6/1997 | Wen et al. | 430/567 |
| 5,716,774 | A | * | 2/1998 | Dickerson et al. | 430/571 |
| 6,228,573 | B1 | * | 5/2001 | Keevert, Jr. et al. | 430/569 |
| 2002/0068247 | A1 | * | 6/2002 | Ihama et al. | 430/567 |

FOREIGN PATENT DOCUMENTS

| | | | |
|---|---|---|---|
| EP | 0 228 256 | | 7/1987 |
| EP | 0 507 701 | | 10/1992 |
| EP | 843 208 | * | 5/1998 |
| EP | 911 687 | * | 4/1999 |

OTHER PUBLICATIONS

James, "The Theory of the Photographic Process", Fourth Edition 1977, p. 67.*

European Search Report, Application No. EP 00 20 2740 (Jan. 8, 2001).

* cited by examiner

*Primary Examiner*—Janet Baxter
*Assistant Examiner*—Amanda C. Walke
(74) *Attorney, Agent, or Firm*—Joseph T. Guy; Nexsen Pruet Jacobs & Pollard, LLC

(57) ABSTRACT

A method has been described for preparing an ultrathin tabular grain emulsion rich in silver bromide, having {111} major faces, wherein tabular grains having a thickness of less than 0.08 μm exhibit an average aspect ratio of more than 5:1 and account for at least 75% by number of hexagonal grains and a coefficient of variation on average equivalent surface area of less than 0.50. The process is characterized in that during formation, (a) pH is maintained from 0.8 to 10; (b) a gelatino-peptizer is present in a concentration of 0 to 50 g per liter of dispersing medium, and (c) pBr having a value of at least 1.8 is maintained during grain nucleation and pBr is maintained at less than 2.4 during growth provided that a gelatin peptizer which is free from calcium ions and has a methionine content of less than 30 micromoles per gram of gelatino-peptizer is present.

14 Claims, No Drawings

METHOD OF PREPARING ULTRATHIN LIGHT-SENSITIVE TABULAR GRAIN EMULSIONS RICH IN SILVER BROMIDE

This application claims the benefit of Provisional application No. 60/227,046, filed Aug. 21, 2000.

FIELD OF THE INVENTION

The present invention relates to a method of preparing light-sensitive ultrathin tabular grains rich in silver bromide, having {111} major faces.

BACKGROUND OF THE INVENTION

High aspect ratio tabular grains exhibit several pronounced photographic advantages as is well-known since their introduction into photographic applications in the eighties. Thanks to their particular morphology greater amounts of spectral sensitizers can be adsorbed per mole of silver halide if compared with classical globular (e.g. cubic or octahedral) grains. As a consequence such spectrally sensitized tabular grains show an improved speed-granularity relationship and a wide separation between their blue speed and minus blue speed. Sharpness of photographic images can be improved using tabular grains thanks to their lower light scattering properties, again if compared with conventionally known globular emulsion grains. In color negative materials e.g. the conventional sequence of the light-sensitive layers can be altered and the yellow filter layer can be omitted. In developed black-and-white images high covering power is obtained even at high hardening levels. Alternatively reduced silver halide coverages can be achieved if desired, which again results in improved sharpness. In duplitized radiographic materials the presence of tabular grains reduces the so-called cross-over which is the main factor for sharpness in such materials. Moreover coating amounts of silver can be reduced, further in favor of production cost and ecology.

An emulsion is generally understood to be a "tabular grain emulsion" when tabular grains account for at least 50 percent of total grain projected area. A grain is generally considered to be a tabular grain when the ratio of its equivalent circular diameter to its thickness is at least 2. The equivalent circular diameter of a grain is the diameter of a circle having an area equal to the projected area of the grain.

Early patent disclosures on high aspect tabular grains, e.g. U.S. Pat. Nos. 4,434,226; 4,439,520; 4,425,425; 4,425,426; 4,433,048 and Research Disclosure, Vol. 225, January 1983, Item 22534, are concerned with high sensitive silver bromide or silver iodobromide emulsions. In a lot of photographic applications high sensitivity remains important. As nowadays ultrathin tabular grains, in the range of from 0.05 up to 0.10 $\mu$m are envisaged as in EP-A's 0 650 085, 0 667 557, 0 701 164, 0 701 166, 0 706 079, 0 699 945 up to 0 699 951, 0 756 199, 0 758 758 and in U.S. Pat. Nos. 5,470,698; 5,641,618; 5,667,955 it is clear that a major role is dedicated to spectral sensitization of such thin tabular grains, making use of huge sensitizing amounts thereof, in order to provide high speed, high covering power, low cross-over and a low level of residual colour after (rapid) processing. As it remains important to provide a high a percentage of tabular grains as high as possible within the whole emulsion crystal population, in favor of "chemical homogneity", reflected in sensitometric benifits (like desired higher contrast e.g.) as a result of "physical" or "morphological homogeneity" offered by the said tabular grains, it is clear that every improvement in that direction is highly appreciated. Without taking into account well-defined emulsion preparation parameters when preparing tabular grains, it is well-known by a person skilled in the art of photography that such a method leads to grain populations consisting of a mixture of all shapes of crystals.

As a consequence many attempts have been made in order to improve the degree of homogeneity of the size and shape of the crystals. In this context EP-A's 0 566 076; 0 506 947; 0 518 066; 0 513 722 and 0 911 687 and U.S. Pat. No. 4,797,354 are related with the preparation of monodisperse hexagonal tabular crystals. In said U.S. Pat. No. 4,797,354 the preparation has been described of tabular emulsions having a high percentage of hexagonal, tabular crystals accounting for 70 to 100% of the total projected area of the said crystals with an average aspect ratio of from 2.5/1 to 20/1. However the examples therein, and in the other references cited, except for the said EP-A 0 911 687 are illustrative for a low yield of silver halide emulsion in the reaction vessel mixture, said yield being defined as amount of silver nitrate precipitated per liter of the said reaction vessel mixture.

For radiographic applications photographic advantages of tabular grains, if compared with normal globular grains, are a high covering power at high forehardening levels as set forth in U.S. Pat. No. 4,414,304. Further a high developability and high sharpness especially in double side coated spectrally sensitized materials can be obtained. The thinner the tabular grains and the lower the number of non-tabular grains in the total grain population the greater these advantages are. To express it in another way: a high degree of homogeneity in grain morphology is desired, leading to a high covering power in order to further offer the possibility to coat lower amounts of silver. Moreover with respect to ecology it is of utmost importance to prepare tabular grains rich in silver bromide having an enhanced covering power. The present invention thus further extends the teachings on thin tabular {111} emulsion grains rich in silver bromide showing a high degree of homogeneity.

OBJECTS OF THE INVENTION

It is an object to reduce the amount of silver halide coated in black-and-white materials, and more particularly, those coated on one or both sides of a transparent support as used in radiographic applications, in order to have reduced production costs before selling those materials and environmental load after processing said materials after exposure.

As ultrathin grains having {111} major faces are envisaged to offer a valuable tool to reach the objects of the present invention it was a further object to provide a method to produce said ultrathin grains, preferably having an average grain thickness of less than 0.08 $\mu$m and even more preferably of less than 0.06 $\mu$m.

It was still a further object of the present invention to add at least one spectral sensitizer in amounts providing high speed, covering power and low cross-over.

Further objects will become apparent from the description hereinafter.

SUMMARY OF THE INVENTION

It has been found that the objects of the present invention are attained by a preparation method, within a temperature-controlled reaction vessel, of an ultrathin tabular grain emulsion rich in silver bromide, having {111} major faces, wherein tabular grains having a thickness of less than 0.08 $\mu$m exhibit an average aspect ratio of more than 5:1 and account for at least 80 percent of total grain projected area of said grains, said process comprising introducing into a temperature-controlled reaction vessel an aqueous dispersing medium and silver, bromide, and, optionally, iodide and/or chloride, and maintaining pBr values within said reaction vessel during grain nucleation and growth that favors the formation and growth of tabular grains, characterized in that at the time said tabular grains are being formed, (a) pH in said reaction vessel is maintained at a value ranging from 0.8 to 10; (b) a gelatino-peptizer is present in the reaction vessel in a concentration of from 0 to 50 g per liter of said dispersing medium, and pBr within said reaction vessel has a value of at least 1.8 is maintained during grain nucleation, wherein nucleation is performed in a reaction vessel at a temperature in the range from 10–60° C., more preferably in the range from 10–50° C., and even more preferably in the range from 40–50° C., and a pBr value within said reaction vessel is maintained at a value of less than 2.4 during growth, wherein growth is performed in a reaction vessel at a temperature in the range from 40–80° C. (in the range from 40–50° C. if an average grain thickness of 0.06 μm is envisaged), provided that a gelatino peptizer which is free from calcium ions and has a methionine content of less than 30 micromoles per gram of gelatino-peptizer (oxidized to a degree in order to have a methionine content of at most 4000 ppm) is present in said dispersing medium during grain nucleation and growth.

Moreover a photographic material comprising an emulsion prepared according to the method of the present invention has been claimed. Specific features for preferred embodiments of the invention are set out in the dependent claims.

Further advantages and embodiments of the present invention will become apparent from the following description.

DETAILED DESCRIPTION OF THE INVENTION

As can be derived from the statement of the present invention set forth above, it is an essential feature that in the temperature-controlled reaction vessel a gelatino peptizer is provided which is free from calcium ions and has a methionine content of less than 30 μmoles per gram of gelatino-peptizer (oxidized to a degree in order to have a methionine content of at most 4000 ppm) and that the gelatino peptizer is present in said dispersing medium during grain nucleation and growth.

The calcium content of most commercial high-quality inert gelatins is about 0.4% or about 100 mmol/kg, measured at the end of the preparation process of inert gelatin. The basis for a high-quality gelatin is preferably formed by pure, degreased hard cattle bones. In a first preparation step the bones are treated with acid in order to remove calcium and magnesium phosphates. This step is followed by an alkaline hydrolysis step, wherein mostly use is made of calcium hydroxide. At the low pH used to remove the phosphates the calcium ions, bound to specific amino acids of the polypeptide, are exchanged with the protons from the used acid. During the alkaline hydrolysis with calcium hydroxide the polypeptide is saturated with calcium ions again. After diafiltration the non-removable calcium concentration in the gelatin is about 0.5% or 125 mmol/kg. When slightly acidifying during washing the calcium content can be reduced to about 0.4% (40 ppm) or 100 mmol/kg. These and other data can be found in the scientific publication "Influence of Calcium on the Physical properties of Gelatin Solutions and on Symplex Formation with Macromolecular Polyanions" by B. H. Tavernier, J. Phot. Sci., Vol. 40, (1992), p. 168–173. The author concluded that complex-bound calcium ions strongly decrease the electric potential carried by gelatin. The influence of calcium ions on physical characteristics such as viscosity was found to be non-significant. So called "calcium free gelatin" is obtained by cation exchange by means of an ion exchange resin, preferably a so-called mixed-bed resin. Substantially "calcium free gelatin" is thus defined as gelatin with a calcium content at a level below 40 ppm which corresponds with the analytical detection limit.

On the other hand oxidized gelatin is commonly defined as a gelatin having a methionine content of less than 30 μmol/g, which corresponds with an amount of about 4400 ppm or less. So gelatin can e.g. be oxidized by means of e.g. hydrogen peroxide. A publication on the determination of methionine and its oxides in gelatin can be found e.g. in J. Phot. Sci., Vol. 41, (1993), p. 172–175, by S. Tani and T. Tani. A high number of tabular grains rich in silver bromide in the total grain population is obtained if use is made in the preparation method of so-called "oxidized gelatin", characterized by the presence in the said gelatin of amounts of methionine of less than 30 μmoles per gram of gelatin as claimed in U.S. Pat. No. 4,713,320. Modification of the methionine content of a gelatino-dispersion medium by means of an oxidizer which should be added to the reaction vessel immediately before nucleation formation can also be applied as has been described in U.S. Pat. No. 5,372,975, wherein seed grains are further added. Seed grains formed in the presence of an oxidizing agent have futher been described in JP-A 05-210187, in JP-A 06-003758 and in JP-A 06-003759. Processing a gelatin solution by means of H202 has e.g. been described in JP-A 05-341415. Other oxidizing agents besides hydrogen peroxide as e.g. ozone, peroxy acid salts, halogens, thiosulphonic acid salts, quinones and organic peroxides can also be used as has been disclosed in U.S. Pat. No. 5,489,504. Oxidation of methionine reduces the complexing ablity of gelatin.

In order to determine the methionine content of gelatin in a quantitative manner many references from literature are available as e.g. in J.Phot.Sc., Vol. 28(1980), p.111–118 wherein as most obvious reducing substances in gelatin methionine residues of the macromolecule are determined in reaction with Au(III)-ions. The so-called "gold number" permits determination of amounts of methionine in the gelatin following the rule that 1 μmole of Au corresponds with 1.6 μmole of methionine. In J.Phot.Sc., Vol. 33(1989), p.10–17 the methionine content was determined making use of the gas chromatographic procedure developed by Apostolatos and Hoff (Anal. Biochem. Vol. 118(1981), p.126) and applied to gelatin by Rose and Kaplan. In this article calorimetry is used in a quantitative procedure for determining methionine (constant over initial pH range examined: 3.0–8.0). In J.Phot.Sc., Vol. 40(1992), p.149–151 amounts of methionine, methionine sulphoxide and methionine sulphone are determined by a chromatographic technique for amino acids (Hitachi Amino Acid Analyser), whereas in J.Phot.Sc., Vol. 41(1993), p.172–175, these compounds are determined by HPLC-techniques. In J.Phot.Sc., Vol. 39(1995), p. 367–372 it has been established that a good correlation between methionine content determined by Rose and Kaplan making use of gas chromatographic techniques (4th IAG Conference, Fribourg 1985, Amman-Brass & Pouradier) and the Scatchard technique (described in J.Phot.Sc., Vol. 42(1994), p.117–119) can be found. In the said technique the interaction at pH=3.0 of Ag+ and gelatin is determined by means of potential measurements of free Ag+-ions.

The method of the present invention, wherein, at the time said tabular grains are being formed in the temperature-controlled reaction vessel, (a) has a pH in the said reaction vessel, which is maintained at a value ranging from 0.8 to 10.0;

(b) provides a gelatino-peptizer which should be present in the reaction vessel in a concentration of from 0 to 50 g per liter of said dispersing medium, and (c) has a pBr value within said reaction vessel of at least 1.8, which is maintained at the said value during grain nucleation, wherein nucleation is performed in a reaction vessel at a temperature in the range from 10–60° C., more preferably in the range from 10–50° C., and still more preferably in the range from 40–50° C.,; whereas a pBr value within said reaction vessel is maintained at a value of less than 2.4 during growth, wherein growth is performed in a reaction vessel at a temperature in the range from 40–80° C. (in the range from 40–50° C. if an average grain thickness of 0.06 μm is envisaged) only leads to the desired thin tabular grains if the gelatino peptizer is free from calcium ions and has a methionine content of less than 30 μmoles per gram of said gelatino-peptizer and when said gelatino-peptizer is present in said dispersing medium during grain nucleation and growth.

Control of those differing, well-defined temperature ranges and pBr values during nucleation and growth unambiguously results in the preparation of ultrathin tabular grains rich in silver bromide having {111} major faces, wherein tabular grains having a thickness of less than 0.08 μm (and at least 0.03 μm), exhibit an average aspect ratio of more than 5:1, and account for at least 80 percent of total grain projected area of said emulsion grains or crystals.

During precipitation into said temperature-controlled reaction vessel in said aqueous dispersing medium silver, bromide, and, optionally, chloride and/or iodide ions are introduced, while maintaining pBr values within said reaction vessel during grain nucleation and growth in order to favour the formation and growth of the desired thin tabular grains under the conditions according to the method of the present invention set forth above.

According to the method of the present invention after preparing in the reaction vessel, the temperature of which is controlled in the range between 10 and 60° C., more preferably in the range from 10–50° C., and still more preferably in the range from 40–50° C., the dispersion medium containing calcium-free gelatin having less than 30 μmoles of methionine per gram in a concentration of from 0 to 50 g per liter, a total amount of silver nitrate of less than 10% by weight, and more preferably 0.5% to 5.0%, is added during the nucleation step which consists of simultaneous addition of silver nitrate and halide (preferably pure bromide, optionally in the presence of very small amounts—less than 1 mole % versus bromide—of iodide) salts at the prescribed pBr value of at least 1.8.

In one embodiment according to the method of the present invention less than 50% of said dispersing medium is present during nucleation, the rest being added before or during growth; wherein said gelatino-peptizer is present in a total amount of less than 5% per liter of dispersing medium, and even more preferably in a total amount of from 0.5% to 2.0% per liter of dispersing medium.

With respect to conditions of pH, in one embodiment according to the present invention pH in said temperature-controlled reaction vessel is maintained at a value ranging from 0.8 to 3.0 during grain nucleation and from 0.8 to 8.0 during grain growth.

With respect to conditions of pBr, in one embodiment according to the present invention, said pBr within said reaction vessel is maintained in the range of 2.3–2.5 during grain nucleation, wherein nucleation is performed in a reaction vessel at a temperature in the range from 10–60° C., more preferably in the range from 10–50° C., and even more preferably in the range from 40–50° C., e.g. 45° C. as in most inventive examples given hereinafter.

In another embodiment according to the method of the present invention, growing said silver halide crystal nuclei proceeds by precipitation of silver brom(oiod)ide or silver brom(ochloro)(iod)ide by means of double-jet precipitation of an aqueous silver nitrate solution and an aqueous solution comprising the halide ions, wherein more than 90% and more preferably up to 95% by weight of the total amount of silver nitrate is consumed. It is clear that the method of the present invention is related with thin tabular grains having {111} major faces and which is composed of silver halide crystals rich in silver bromide, i.a. containing more than 90 mole % of silver bromide, more preferably more than 95 mole % of silver bromide and even more preferably at least 99 mole % of silver bromide, whereas the other halides are optionally present: chloride in an amount in the range from 0% up to at most 10 mole % and iodide in an amount of at most 3 mole % and even more preferably in the range from 0.05 mole % up to 1.0 mole %. In one embodiment according to the the method of the present invention, iodide ions, when present, are added after ending growth by iodide providing compounds. In another embodiment according to the method of the present invention said iodide providing compounds are potassium iodide, iodate ions, organic iodide releasing compounds, $I_3^-$ or ultrafine AgI microcrystals having an average diameter of less than 0.050 μm.) Information about practical use of such compounds providing iodide ions in emulsion preparation can be found in EP-A's 0 563 701, 0 563 708, 0 561 415, 0 651 284 and 0 926 133 and in U.S. Pat. Nos. 5,498,516; 5,736,412 and 5,879,874.

The different precipitation steps can be alternated by physical ripening steps or by so called "neutralization steps", during which the pAg value is changed to a value required in the next growth step by adding an amount of silver nitrate solution or a water soluble halide salt within a well-defined time of addition by means of the single-jet technique. Alternative ways to regulate the pAg to the desired value before continuing the processing are diluting the emulsion present in the reaction vessel, diafiltration or ultrafiltration and even flocculation and washing procedures, the last techniques being preferred to concentrate the emulsion crystals in the reaction vessel. Any combination or any choice of the mentioned techniques may be applied thereto, provided that pBr is controlled during the growth steps at a value of less than 2.4 for a temperature-controlled reaction vessel having a temperature in the range from 40–80° C. (and more particularly from 40–50° C. if an average grain thickness of 0.06 μm is envisaged).

At least two growth steps are commonly used. The ratio of the second growth step to the first growth step and the pBr in this second growth step is such that the tabular {111} grains rich in silver bromide at the end of the preparation according to the method of the present invention exhibit an average aspect ratio of more than 2:1.

According to the method of the present invention thin {111} tabular grains rich in silver bromide having a thickness of at least 0.03 μm, exhibiting an average aspect ratio of from 5:1 to 50:1 are thus prepared, said tabular grains accounting for at least 75%, and more preferably at least 80%, by number of hexagonal grains and a coefficient of variation on average equivalent surface area of less than 0.50.

During the growth step(s) an increasing flow rate of silver and halide solutions is preferably applied, e.g. a linearly increasing flow rate. Typically the flow rate at the end is about 3 to 10 times greater then at the start of the growth step.

In a preferred embodiment according to the method according of the present invention the molar ratio of reactant flow rates during grain nucleation to reactant flow rates at the start of grain growth ranges from 1.0 to 50.

In another preferred embodiment according to the present invention the ratio of silver bromide precipitated during growth versus during nucleation ranges from 10:1 up to 100:1.

Whereas according to the method of the present invention the whole precipitation reaction, including nucleation, growth, neutralization and Ostwald ripening or physical ripening steps are performed in one temperature-controlled reaction vessel, it is clear that nuclei can be prepared in a separate vessel, whereas growth of the said nuclei may proceed in another vessel, provided that the conditions of pH, pBr and temperature are in accordance with those as described in the statement of the present invention.

According to another embodiment of the method of the present invention, besides performing nuclation in a concentrated reaction vessel, it may be important to concentrate the reaction mixture volume obtained by ultrafiltration during the precipitation growth steps by applying during said ultrafiltration process an ultrafiltration flux equal to (as preferred in steady-state circumstances) or higher than total flow rates of silver salt and halide salt solutions, thereby concentrating silver halide formed in the said reaction vessel to e.g. at least 250 g, expressed as an equivalent amount of silver nitrate, per liter, or even from 300 g up to 450 g per liter. In order to get the preferred volume of the reaction mixture in the reaction vessel it is however possible that a temporary lower ultrafiltration flux is required. The practically applied ultrafiltration or membrane flux further is a function of the total operative surface of the membrane and the trans-membrane pressure. The right choice of the membrane used in order to reach the desired volume of the reaction mixture in the reaction vessel is thus very important. Preferably the ultrafiltration procedure is applied in a continuous way during the precipitation steps, but, if required, it can be interrupted for short periods as e.g. during physical ripening preferably no ultrafiltration is applied. By applying the ultrafiltration procedure the total reaction mixture volume can be lowered during the precipitation. Alternatively the reaction mixture volume can be readjusted, e.g. kept constant by the application of an additional jet of water. By those methods it is possible to reduce the end precipitation volume and to concentrate silver halide to values set forth hereinbefore. This achievement cannot be attained by solely concentrating the silver ion and halide ion jets as in that case a tremendous deviation from the required morphologic homogeneity and homogeneity of the crystal size distribution is observed, but as already set forth hereinbefore, by the presence in low amounts of oxidized gelatin in a low starting volume of the reaction vessel. In a preferred embodiment an ultrafiltration module is conceived in such a way that the total volume of the ultrafiltration module and of its connecting means, is lower than ⅓ of the total precipitation volume. Moreover the circulation flux through the ultrafiltration module is preferably high enough, in order to achieve a delay time in the module of any liquid volume unit of lower than 60 seconds and, most preferably lower than 30 seconds. Even delay times as low as 10 seconds can be achieved.

A preferred ultrafiltration module for the practice of this invention is a ROMICON HF2-20-PM10, provided with a pump. For a typical precipitation (see examples) the flow rate of the silver ion jet during the growth step(s) is linearly increased to an end rate of 25 ml/min per 500 g of silver nitrate to be precipitated and a linearly increasing flux having an end rate of about 50 ml/min is applied. But in the case of more strongly increasing flow rates, e.g. quadratically increasing flow rates, a flux of about 200 ml/min can be established if required.

According to another embodiment of the method of the present invention a variation of the grain size distribution of the equivalent circular diameters of tabular grains having a value of less than 0.50 is obtained, wherein the percentage by number of hexagonal grains is at least 80%. Said "variation" for the thus obtained thin tabular grains is defined as the homogeneity (width) of the distribution, independent on the average grain size.

Preparation of silver bromo(chloro)iodide emulsion crystals can be achieved by mixing a soluble bromide or bromochloride mixture and a soluble iodide salt in one or more of the halide solutions up to the desired concentrations, expressed in mol %, required in each preparation step by double jet or by a triple jet technique by separate addition of an iodide containing aqueous solution. Due to the lower solubility of silver iodide in comparison with silver bromide, said iodide ions are able to displace bromide and chloride ions from the grain, a technique known in the art as conversion. Iodide ions may also be incorporated into the silver halide crystal lattice by the addition of a previously prepared silver iodide micrate emulsion, composed of either pure silver iodide or mixed halide ultrafine crystals, but as has already set forth hereinbefore in a preferred embodiment iodide releasing agents are used, at least partially, e.g. in one or more conversion steps during or at the end of the precipitation. Even bromide releasing agents are not excluded in the precipitation steps according to the method of this invention.

Two or more types of tabular silver halide emulsions that have been prepared differently can be mixed for forming a photographic emulsion for use in photographic materials according to the present invention, depending on the desired specifications. Thin tabular silver halide emulsions rich in silver bromide, prepared by the method of the present invention, can be chemically sensitized as has been described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeni-den" edited by H. Frieser and published by Akademische Verlagsgesell-schaft (1968). Chemical sensitization has e.g. also been described in Research Disclosure N° 38957 (September 1996), Chapter IV.

As described in said literature chemical sensitization can be carried out by effecting the ripening in the presence of small amounts of compounds containing sulphur e.g. thiosulphate, thiocyanate, thioureas, sulphites, mercapto compounds, and rhodamines. Said compounds containing sulphur can also be, at least partially, replaced by compounds containing selenium and/or tellurium. The emulsions may be sensitized also by means of gold-sulphur, gold-sulphur-selenium, gold-selenium ripeners or by means of reductors as e.g. tin compounds described in GB-Patent 789,823, amines, hydrazine derivatives, formamidine-sulphinic acids, and silane compounds. Useful information about chemical sensitization of tabular grains by means of selenium compounds can be found in EP-A's 0 404 142, 0 443 453, 0 488 029, 0 585 787 and 0 638 840 and in U.S. Pat. Nos. 5,028,522; 5,112,733; 5,158,892; 5,397,692; 5,348,850; 5,466,571; 5,573,901 and 5,888,717; whereas information about chemical sensitization of tabular grains by means of tellurium compounds can be found in EP-A's 0 619 515, 0 809 137 and in EP-Application No. 99202439, filed Jul. 23, 1999 and in U.S. Pat. Nos. 5,459,027; 5,395,745; 5,561,033; 5,358,850; 5,654,134; 5,759,760; 5,888,717.

The tabular silver halide emulsions may be spectrally sensitized with methine dyes such as those described by F. M. Hamer in "The Cyanine Dyes and Related Compounds", 1964, John Wiley & Sons and in Research Disclosure N° 38957 (1994), Chapter V. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534. Oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyl-oxacarbo-cyanine hydroxide. Imidacarbocyanines as e.g. those described in Research Disclosure N° 37312 (1995) may be useful as well as combinations of oxacarbocyanines and imidacarbocyanines as in EP-A 0 590 593 from the viewpoint of sensitivity as well as from the viewpoint of decolouring properties and stain removal in the processing of materials containing spectrally sensitized tabular grains rich in silver bromide as in this invention.

Useful information about spectral sensitization, applicable to thin tabular grains prepared according to the method of the present invention can be found in EP-A's 0 487 010, 0 506 584, 0 509 519, 0 514 105, 0 590 715, 0 556 413, 0 608 312, 0 614 542, 0 547 568, 0 634 688, 0 562 476, 0 608 955, 0 712 033, 0 712 034, 0 651 283, 0 699 945, 0 666 497, 0 794 232, 0 844 516, 0 833 195, 0 953 867, 0 809 139 and 0 897 131; in U.S. Pat. Nos. 5,118,600; 5,141,846; 5,348,849; 5,259,016; 5,308,748; 5,391,475; 5,364,755; 5,348,850; 5,536,634; 5,851,752; 5,612,176; 5,614,359; 5,641,618; 5,700,608; 5,851,243; 5,928,854; 5,972,590 and in EP-Application Nos. 999204008, 99204009, and 99204011, filed Nov. 26, 1999. In view of the desired low residual colour after processing of materials coated with emulsions having thin tabular grains and requiring huge amounts of spectral sensitizer the methods with respect to spectrally sensitize said grains as described in EP-A's 0 953 867 and in EP-Applications Nos. 99201189 and 99201190, both filed Apr. 16, 1999 are particularly recommended.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This may also be done, just as in e.g. EP-A's 0 556 413 and 0 953 867 with the emulsions prepared according to the present invention, wherein the chemical sensitization proceeds in the presence of one or more phenidone and derivatives, a dihydroxy benzene as hydroquinone, resorcinol, catechol and/or a derivative(s) therefrom, one or more stabilizer(s) or antifoggant(s), one or more spectral sensitizer(s) or combinations of said ingredients. Especially 1-p-carboxyphenyl, 4,4' dimethyl-pyrazolidine-3-one may be added as a preferred auxiliary agent.

The gelatinous silver halide emulsion rich in silver bromide prepared according to the method of the present invention, characterized by a specific gelatin composition as set forth hereinbefore, is further coated in hydrophilic layer (s) which may, just as non-light-sensitive layers of the photographic material according to this invention, comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium or benzselenazolium salts as described e.g. in EP-A 0 488 030 and 0 490 297, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotria-zoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes (as in EP-A 0 843 209, wherein azaindenes or tetra-azaindenes have been added between emulsion grain formation and emulsion washing; and in EP-A 0 845 703) and pentazaindenes, especially those described by Birr in Z. Wiss. Phot. 47 (1952), pages 2–58, triazolopyrimidines such as those described in GB 1,203,757, GB 1,209,146, JP-A 75/39537, and GB-A 1,500,278, and 7-hydroxy-s-triazolo-[1,5-a]-pyrimidines as described in U.S. Pat. No. 4,727,017, and other compounds such as benzenethiosulfonic acid, benzenethiosulfinic acid and benzenethiosulfonic acid amide or N-containing heterorings in general as described in EP-A's 0 547 568 and 0 452 811. Other compounds that can be used as fog-inhibiting compounds are described in EP-A 0 590 620 (masked heterocyclic antifoggants), in EP-A 0 658 803 (alkyne substituted heterocyclic compounds), in EP-A 0 961 164 (amino-substituted cyclopentadiones) and in Research Disclosure N° 17643 (1978), Chapter VI and in RD N° 38957 (1996), Chapter VII. Many of these fog-inhibiting compounds may have been already added before or during chemical ripening of the tabular silver halide crystals rich in silver bromide.

It is clear that additional gelatin is added in a later stage of the emulsion preparation, e.g. after washing, in order to establish optimal coating conditions and/or to establish the required thickness of the coated emulsion layer. Preferably a gelatin to silver halide ratio ranging from 0.3 to 1.0 is then obtained, wherein extra gelatin added is not required to have a composition as specific as in the preparation step of the grains according to the method of the present invention. Another binder may also be added instead of or in addition to gelatin or gelatin derivatives as e.g. phthalated gelatin. Useful vehicles, vehicle extenders, vehicle-like addenda and vehicle related addenda have been described e.g. in Research Disclosures Nos 36544 (1994) and 38957 (1996), chapter II.

The gelatin binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, chromium salts as e.g. chromium acetate and chromium alum, aldehydes e.g. formaldehyde, glyoxal, and glutaraldehyde, N-methylol compounds e.g. dimethylol-urea and methyloldimethylhydantoin, dioxan derivatives e.g. 2,3-dihydroxydioxan, active vinyl compounds e.g. 1,3,5-triacryloyl-hexahydro-s-trizine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

In a preferred embodiment the hydrophilic layer package of silver halide photographic materials comprising in one or more light-sensitive layers one or more {111} tabular emulsions rich in silver bromide crystals prepared according to the method of the present invention, has a swelling degree of not more than 200%. Said swelling degree is determined by means of the following procedure: a sample of the coated material is incubated at 57° C. and 34% RH for 3 days, whereafter the thickness (a) of the layer assemblage is measured. Thereafter the sample is immersed in distilled water at 21° C. for 3 minutes and the thickness (b) of the swollen layer is measured. The swelling ratio is then calculated as: $(b-a)/a\times100(\%)$.

The gelatinous emulsions comprising thin tabular grains rich in silver bromide of the present invention can be used in various types of photographic elements, e.g. black and white silver halide photographic materials, like materials used for X-ray diagnostic purposes, or colour sensitive materials.

According to the present invention a photographic material comprising a support and at least one light-sensitive silver halide emulsion layer on at least one side of said support is thus provided, wherein said emulsion layer(s) comprise(s) one or more emulsion(s) containing {111} tabular silver bromide or bromoiodide (optionally silver chlorobromide or chlorobromiodide) emulsion grains prepared according to the method of the present invention disclosed hereinbefore (silver bromide being present therein in an amount of at least 90 mole %, based on silver).

According to the present invention said photographic material is a single or double side coated X-ray material. In one embodiment according to the present invention said photographic element or material thus comprises a support and on one or on each side thereof one or more silver halide emulsion layer(s) coated from a gelatinous emulsion according to the present invention. More specifically said photographic material is thus a single-side or double-side coated X-ray material.

The single-side coated x-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the present invention. By using duplitized emulsions differing in photographic speed by at least 0.15 log E a gain in cross-over exposure in double side coated materials can be obtained. In the case of colour photography the material contains blue, green and red sensitive layers each of which can be single coated, but merely consists of double or even triple layers. Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc.

The photographic element of the present invention may further comprise various kinds of coating physical property modifying addenda as described in RD's Nos 36544 (1994) and 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element of the present invention may further comprise various other additives such as e.g. compounds improving the dimensional stability of the photographic element, UV-absorbers, spacing agents and plasticizers.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD's Nos. 36544 (1994) and 38957 (1996), Chapter VI, wherein also suitable optical brighteners are mentioned. UV-absorbers are especially useful in colour materials where they prevent the fading by light of the colour images formed after processing.

Spacing agents can be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl(meth) acrylates, (meth)acrylamides, vinyl esters, acrylonitriles, olefins, and styrenes, or copolymers of the above with acrylic acids, methacrylic acids, $\alpha,\beta$-unsaturated dicarboxylic acids, hydroxyalkyl(meth)acrylates, sulphoalkyl(meth) acrylates, and styrene sulphonic acids.

The photographic material may contain several non-light sensitive layers, e.g. an antistress topcoat layer, one or more backing layers, and one or more intermediate layers eventually containing filter dyes or antihalation dyes that absorb scattering light and thus promote the image sharpness. Suitable light-absorbing dyes used in these intermediate layers are described in e.g. U.S. Pat. Nos. 4,092,168 and 4,311,787, in DE-A 2,453,217, and in GB-A 7,907,440. Situated in such an intermediate layer between the emulsion layers and the support there will be only a small negligable loss in sensitivity but in rapid processing conditions decolouration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an α-olefin polymer, e.g. a polyethylene layer which optionally contains an anti-halation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-α-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in a preferred embodiment of materials for X-ray diagnostic purposes said materials may be adapted to rapid processing conditions. Preferably an automatically operating processing apparatus is used provided with a system for automatic regeneration (replenishment) of the processing solutions.

The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use developer and fixer solutions free from hardening agents, wherein, in the developer ascorbic acid, analogues and derivatives thereof can be used instead of the commonly used hydroquinone and wherein, in the fixer, sodium thiosulphate instead of ammonium thiosulphate can be used.

By the method of the present invention it is thus possible to provide a high covering power for different hardening levels of the layer material, wherein the substantially thin hexagonal {111} tabular grains rich in silver bromide are coated in gelatinous emulsion form, accounting for at least 75% , and more preferably at least 80%, by number of hexagonal grains, further having a coefficient of variation on average equivalent surface area of less than 0.50.

EXAMPLE

While the present invention will, in the present example, be described in connection with a preferred embodiment thereof, it will be understood that it is not intended to limit the invention to that embodiment. On the contrary, it is intended to cover all alternatives, modifications and equivalents. as may be included in the spirit and scope of the invention as defined by the claims.

Emulsion Preparation

To a solution of 7.5 g of oxidized gelatin, free from Ca-ions, in 3 l of demineralized water at x° C. (specified in the Table as corresponding with the nucleation temperature), adjusted to a pH of 1.8 by adding $H_2SO_4$ and a pBr of 2.39 by adding a diluted solution of potassium bromide, stirred up to a rate of 700 r.p.m., were added by a double jet method aqueous solutions of 1.96 M $AgNO_3$ (hereinafter referred to as A1') and 1.96 M KBr (hereinafter referred to as B1): 7.2 ml of A1 and 7.2 ml of B1 were added in a time interval of 27 seconds. The temperature was increased up to y° C. (specified in the Table hereinafter just as for x) over a period of 32 minutes, after which a solution of 50 g of gelatin (further specified in the Table hereinafter as corresponding with gelatin A, B, C or D) in 500 ml of demineralized water of y° C. was added. 2 minutes later UAg was controlled and should be in the range—at 45° C.—from 38±5 mV; 55 mV at 70° C. (measured versus a Ag/AgCl(sat.) reference electrode), corresponding with a pBr value of 2.39 and pH was set to a value of 5.0±0.3.

The rate of stirring was decreased to 500 r.p.m. and 7 minutes later B1 was added at a rate of 7.5 ml/min. during 436 seconds, if the temperature was 45° C., followed by a addition of A1 at a rate of 3.8 ml/min. In 60 s while adding B1 at a rate in order to get a UAg of −20 mV at a temperature of 45° C., corresponding with a pBr value of 1.47 (at 70° C. pBr=1.28).

In a double jet addition A1 and B1 were added during a growth step taking 7969 seconds at a linearly increasing rate going from 3.8 up to 18.75 ml/min., while adding B1 in order to maintain a constant UAg potential of −20 mV in the reaction vessel, corresponding with a pBr of 1.47. 3 minutes after ending that double-jet addition period, an amount of an emulsion having ultrafine (ca. 0.040 μm) 100% AgI crystals, was added to the reaction vessel in a time of 2 minutes in order to get a total AgI content at the end of precipitation of 0.1 mole % vs. silver precipitated.

The average grain sizes of the silver bromoiodide tabular {111} emulsion grains thus prepared, have been summarized

- as average equivalent volume diameter—measured by M öller counting apparatus, expressing volume of each separate grain after electrochemical reduction—in μm, under dM in the following Table),
- as average equivalent surface area—measured from electron microscopic photographs—in μm, under d4/3 in the following Table,
- as the average thickness, measured from shadowed replicas obtained by electron microscopy.

Besides the procentual amount of hexagons has been tabulated, as well as the "variation", defined as the homogeneity (width) of the distribution, independent on the average grain size.

After nucleation following types of gelatin were added:

A: having Ca-ions and methionine up to a "natural level"

B: having Ca-ions and oxidized gelatin having methionine up to a reduced level

C: having no Ca-ions and methionine up to a "natural level"

D: having no Ca-ions and oxidized gelatin having methionine up to a reduced level

TABLE 1

| Em. No. | X (° C.) | Y (° C.) | Growth gelatin | DM (μm) | d4/3 | Variation | % hexagons | Grain Thickness (μm) |
|---|---|---|---|---|---|---|---|---|
| 1 | 45 | 45 | A | 0.33 | 0.52 | 0.53 | 86 | 0.115 |
| 2 | 45 | 45 | D | 0.42 | | 0.47 | 81 | 0.064 |
| 3 | 45 | 45 | D | 0.39 | 0.58 | 0.43 | 80 | 0.059 |
| 4 | 45 | 45 | C | 0.34 | 0.52 | 0.47 | 90 | 0.124 |
| 5 | 45 | 45 | B | 0.42 | 0.67 | 0.49 | 70 | 0.064 |
| 6 | 20 | 45 | D | 0.28 | 0.45 | 0.49 | 88 | 0.054 |
| 7 | 45 | 70 | A | 0.63 | | 0.44 | 89 | 0.111 |
| 8 | 10 | 70 | A | 0.57 | 0.74 | 0.35 | 88 | 0.083 |
| 9 | 10 | 70 | D | 0.48 | 0.77 | 0.48 | 76 | 0.073 |

As can clearly be concluded from the data in Table 1 hereinbefore a reduced grain thickness of less than 0.08 μm is guaranteed in the presence during nucleation and growth of gelatin D (having no Ca-ions and oxidized gelatin having methionine up to a reduced level) as a gelatin peptizer which is free from calcium ions has a methionine content of less than 30 micromoles per gram of gelatino-peptizer is present in said dispersing medium.

In the alternative it may be concluded that during said precipitation step(s) the said gelatin binder present in said reaction vessel is substantially free of calcium ions and is oxidised to a degree in order to have a methionine content of at most 4000 ppm).

A thickness of less than 0.06 μm can even be attained in the presence of the same gelatin if the temperature range during growth is in the range from 40 up to 50° C.

Having described in detail preferred embodiments of the current invention, it will now be apparent to those skilled in the art that numerous modifications can be made therein without departing from the scope of the invention as defined in the appending claims.

What is claimed is:

1. A method of preparing, within a reaction vessel, an ultrathin tabular grain emulsion rich in silver bromide, having {111} major faces, wherein tabular grains having a thickness of less than 0.08 μm exhibit an average aspect ratio of more than 5:1 and account for at least 75% by number of all hexagonal grains and said tabular grains have a coefficient of variation on average equivalent surface area of less than 0.50, said process comprising:

introducing into a temperature-controlled reaction vessel an aqueous dispersing medium and silver, bromide, and, optionally, iodide and/or chloride, and maintaining pBr values within said reaction vessel during grain nucleation and growth that favors the formation and growth of tabular grains, characterized in that at the time said tabular grains are being formed, (a) pH in said reaction vessel is maintained at a value ranging from 0.8 to 10.0;

(b) a gelatino-peptizer is present in the reaction vessel in a concentration of from 0 to 50 g per liter of said dispersing medium, and (c) pBr within said reaction vessel having a value of at least 1.8 is maintained during grain nucleation, wherein nucleation is performed in a reaction vessel at a temperature in the range from 10–60° C. and a pBr value within said reaction vessel is maintained at a value of less than than 2.4 during growth, wherein growth is performed in a reaction vessel at a temperature in the range from 40–80° C., provided that a gelatin peptizer which is free from calcium ions and has a methionine content of less than 30 micromoles per gram of gelatino-peptizer is present in said dispersing medium during grain nucleation and growth.

2. Method according to claim 1, wherein said tabular grains account for at least 80% by number of hexagonal grains.

3. Method according to claim 1, wherein growth is performed in a reaction vessel at a temperature in the range from 40–50° C.

4. Method according to claim 1, wherein nucleation is performed in a reaction vessel at a temperature in the range from 10–50° C.

5. Method according to claim 1, wherein iodide ions, when present, are added after ending growth by iodide providing compounds, wherein said iodide providing compounds are potassium iodide, iodate, organic iodide releasing compounds, $I_3^-$ or ultrafine AgI microcrystals having an average diameter of less than 0.050 μm.

6. Method according to claim 1, wherein pH in said reaction vessel is maintained at a value ranging from 0.8 to 3.0 during grain nucleation and from 0.8 to 8.0 during grain growth.

7. Method according to claim 1, wherein less than 50% of said dispersing medium is present during nucleation, the rest being added before or during growth; wherein said gelatino-peptizer is present in a total amount of less than 5% per liter of dispersing medium.

8. Method according to claim 7, wherein less than 50% of said dispersing medium is present during nucleation, the rest being added before or during growth; wherein said gelatino-peptizer is present in a total amount of from 0.5% to 2.0% per liter of dispersing medium.

9. Method according to claim 1, wherein pBr within said reaction vessel is maintained in the range of 2.3–2.5 during grain nucleation, wherein nucleation is performed in a reaction vessel at a temperature in the range from 10–60° C.

10. Method according to claim 1, wherein pBr within said reaction vessel is maintained in the range of 2.3–2.5 during grain nucleation, wherein nucleation is performed in a reaction vessel at a temperature in the range from 10–50° C.

11. Method according to claim 1, wherein the molar ratio of reactant flow rates during grain nucleation to reactant flow rates at the start of grain growth ranges from 1.0 to 50.

12. Method according to claim 1, wherein the ratio of silver bromide precipitated during growth versus during nucleation ranges from 10:1 up to 100:1.

13. Photographic material comprising a support and at least one light-sensitive silver halide emulsion layer on at least one side of said support, wherein said emulsion layer(s) comprise(s) one or more emulsion(s) containing {111} tabular silver bromide or bromoiodide emulsion grains prepared according to the method of claim 1.

14. Photographic material according to claim 13, wherein said photographic material is a single or double side coated X-ray material.

* * * * *